United States Patent [19]

Kawai et al.

[11] 4,122,447

[45] Oct. 24, 1978

[54] ENDFIRE-TYPE PHASED ARRAY ANTENNA

[75] Inventors: Yumio Kawai, Hirakata; Michio Ikenishi, Osaka; Hiroshi Ohyama, Hirakata, all of Japan

[73] Assignee: Matsushita Electric Industrial Co., Ltd., Osaka, Japan

[21] Appl. No.: 735,411

[22] Filed: Oct. 26, 1976

[30] Foreign Application Priority Data

Oct. 31, 1975 [JP] Japan ..... 50-131585
Nov. 4, 1975 [JP] Japan ..... 50-132606

[51] Int. Cl.[2] ..... H01Q 21/12; H01Q 21/00

[52] U.S. Cl. ..... 343/814; 343/816; 343/853

[58] Field of Search ..... 343/811, 812, 814, 815, 343/816, 853

[56] References Cited

U.S. PATENT DOCUMENTS

| | | | |
|---|---|---|---|
| 1,964,189 | 6/1934 | Koomans | 343/814 |
| 2,409,944 | 10/1946 | Loughren | 343/814 |
| 2,578,973 | 12/1951 | Hills | 343/853 |
| 3,082,422 | 3/1963 | Watkins | 343/814 |
| 3,750,185 | 7/1973 | Evans | 343/814 |
| 4,010,474 | 3/1977 | Provencher | 343/814 |

OTHER PUBLICATIONS

Hansen; R. C., *Microwave Scanning Antennas,* vol. 3., Academic Press, N.Y., 1966, pp. 5–9.

Jordan; E. C., *Electromagnetic Waves & Radiating Systems,* 2nd ed., Prentice Hall, N. J. 1968, pp. 422–444.

*Primary Examiner*—Alfred E. Smith
*Assistant Examiner*—Harry E. Barlow
*Attorney, Agent, or Firm*—Wenderoth, Lind & Ponack

[57] ABSTRACT

An endfire-type phased array antenna comprises $n$ antenna elements ($n \geqq 3$). The difference of current flowing through the antenna elements is controlled to one which is pre-determined by adjusting each length of the feeders and by coupling the phase inverting circuits to alternate antenna elements. The current amplitude ratio thereof is also controlled to a pre-determined value by using a mixing or distributing circuit. Thus an antenna having a high directivity in front and no radiation in other directions is provided which can be effectively used for preventing multi-path interference in TV or FM.

9 Claims, 15 Drawing Figures

ENDFIRE-TYPE PHASED ARRAY ANTENNA

BACKGROUND OF THE INVENTION

This invention relates to an endfire-type phased array antenna, and more particularly to an improved endfire-type phased array antenna having a high directivity in a wide frequency range and a high directivity protection.

In receiving of a television or FM broadcast, usually there is a problem of multi-path interference, so-called ghosts resulting from an echo of a reflected wave, and in order to prevent such ghosts various attempts have been carried out up to the present. For example, various ghost eliminating circuits using a delay line have been studied, but conventionally there is not provided a satisfactory system for preventing ghosts.

According to the experiments of the inventors, it is found that the most effective result for eliminating ghosts is provided by making the directivity of the antenna sharp and the directivity protection thereof high.

Although there is provided in the prior art an endfire-type phased array antenna having a sharp directivity, in conventional ones the high directivity is realized only around a designed frequency and it is used only in a very narrow band, as described hereinafter.

SUMMARY OF THE INVENTION

Therefore, an object of the present invention is to provide a novel and improved endfire-type phased array antenna which can be effectively used for eliminating ghosts.

Another object of the present invention is to provide an improved endfire-type phased array antenna of a novel configuration which has a sharp directivity, even when it is miniaturized, in a wide frequency range and having a high directivity protection characteristic.

A further object of the present invention is to provide an endfire-type phased array antenna effective for reducing a reflected wave, which causes ghosts, in a simple structure.

These objects of the invention are achieved by providing an endfire-type phased array antenna, which comprises $n$ dipole antenna elements ($n$ being an integer larger than 2, i.e. $n \geqq 3$) arranged in parallel to each other on the same plane, $n$ feeding means connected to each of said $n$ antenna elements and having a pre-determined length, respectively, a circuit for mixing currents flowing through said feeding means with a pre-determined current amplitude ratio and flowing into the mixing circuit in case said antenna is used as a receiving antenna, or for distributing currents into said feeding means with the said pre-determined current amplitude ratio in case when said antenna is used as a transmitting antenna, said phased array antenna containing also phase inverting circuits, wherein alternative (odd or even) antenna elements of said $n$ antenna elements are connected directly to said mixing circuit through each of said $n$ feeding means and the remaining (even or odd) antenna elements are coupled to said mixing circuit through each of said phase inverting circuits.

BRIEF DESCRIPTION OF THE DRAWINGS

These and other objects and the features of the present invention will become apparent from consideration of the following detailed description of the invention together with the accompanying drawings, in which.

Figure 10:
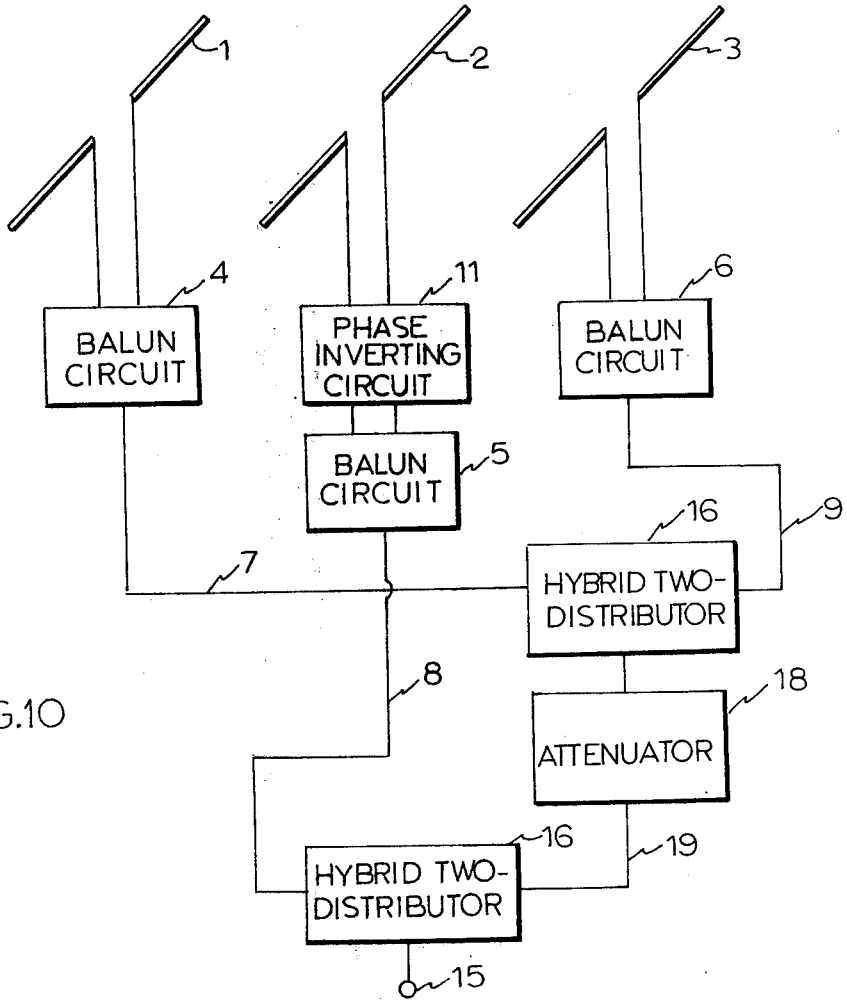
Figure 9:
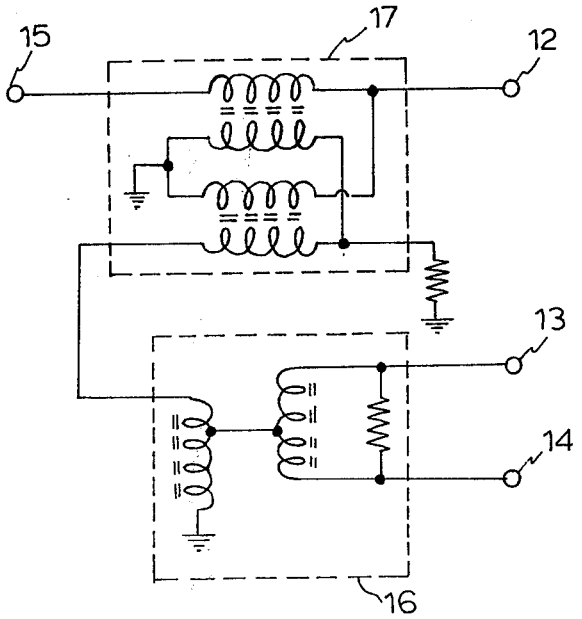

FIGS. *7a* to *d* are circuit diagrams of examples of phase inverting circuits used for the antenna of the invention;

FIGS. *8a* to *c* are circuit diagrams of examples of mixing circuits or distributing circuits used for the antenna of the invention;

FIG. 9 is a circuit diagram of an example of a mixing circuit or a distributing circuit including a phase inverter used for the antenna of the invention; and FIG. 10 is a schematic diagram of a further embodiment of the invention using a plurality of mixing circuits or distributing circuits.

DETAILED DESCRIPTION OF A PREFERRED EMBODIMENT OF THE INVENTION

Figure 1:
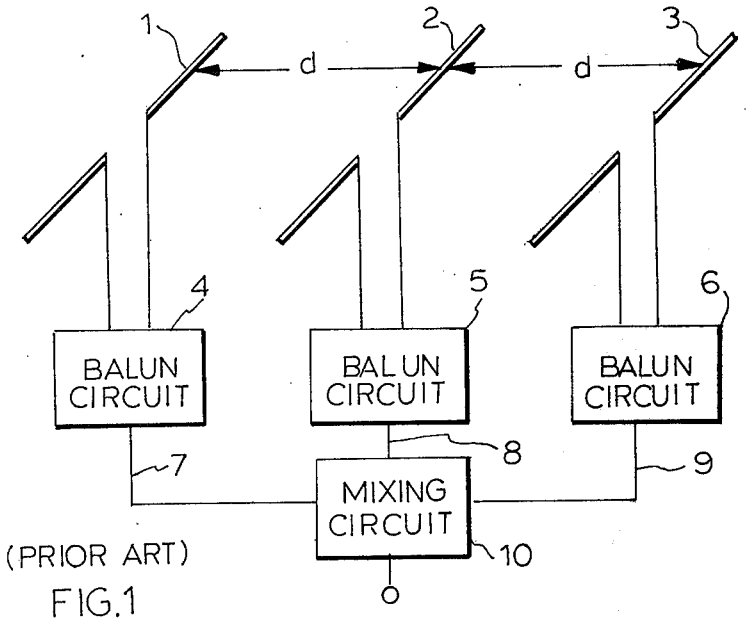
(PRIOR ART) FIG.1
FIG. 1 is a schemtic diagram of a conventional endfire-type phased array antenna comprising three antenna elements.

Before description of a preferred embodiment of the present invention, a conventional endfire-type phased array antenna is described referring to FIG. 1 in order to make the features of the antenna of the invention clear. In FIG. 1, an endfire-type phased array antenna comprises first, second and third antenna elements designated by reference numerals 1, 2 and 3, respectively, balun circuits 4, 5 and 6 connected to the antenna elements 1, 2 and 3, respectively, co-axial type feeders 7, 8 and 9, each of which has a pre-determined length $l_1$, $l_2$ and $l_3$ and connected to the respective balun circuits 4, 5 and 6, and a circuit 10 for mixing currents from the feeders 7, 8 and 9 or for distributing currents to these feeders.

The directivity $D(\theta)$ in the magnetic field, that is, in the vertical plane of the antenna shown in FIG. 1 is expressed as follows:

$$D(\theta)=|I_1\epsilon^{j\phi_1}+I_2\epsilon^{j(k_o d\cos\theta+\phi_2)}+I_3\epsilon^{j(2k_o d\cos\theta+\phi_3)}| \quad (1)$$

where $I_1\epsilon^{j\phi_1}$, $I_2\epsilon^{j\phi_2}$ and $I_3\epsilon^{j\phi_3}$ are values of current flowing through the antenna elements 1, 2 and 3, respectively, $d$ is the interval between the antenna elements 1 and 2 or 2 and 3, and $k_o$ is a propagation constant in the free space which is expressed as $k_o=2\pi/\lambda$ ($\lambda$ is a wavelength). The equation (1) is changed as follows:

$$D(\theta)=|I_1+I_2z+I_3z^2| \quad (2)$$

where $\phi$ and $z$ are defined as follows:

$$\phi=\phi_1-\phi_2=\phi_2-\phi_3$$

$$z=\epsilon^{j(k_o d\cos\theta-\phi)}$$

Factoring the equation (2), it is expressed as follows:

$$D(\theta)=|I_3(z-t_1)(z-t_2)| \quad (3)$$

From the theory of an antenna pattern synthesis of Schelkunoff, the equation (3) shows the product of directivity of two antennas of two antenna elements. Further, as a directivity expressing with a polynominal of $z$ means a directivity of a dipole antenna array from Schelkunoff's theorem, by arranging that $D=0$ at $\theta=180°$ as $D(\theta)=(z-t)^2$ where $t=\epsilon^{-j(k_o d+\phi)}$, the directivity is expressed as follows:

$$D(\theta)=|1-2e^{jk_od(\cos\theta+1)}+e^{j2k_od(\cos\theta+1)}| \quad (4)$$

From the above consideration, as the conditions in order to provide a sharp directivity in front (the direction to the antenna element 3) and in order to prevent radiation in back (the direction to the antenna element 1), there are provided the following conditions where the value of current flowing through the antenna element 1 is set as a standard:

$$\left.\begin{array}{l} I_1 = 1 \\ I_2 = 2 \\ I_3 = 1 \end{array}\right\} \quad (5)$$

$$\left.\begin{array}{l} \phi_1 = o \\ \phi_2 = k_od \pm \pi \quad \phi_3 = 2\,(k_od \pm \pi) \end{array}\right\} \quad (6)$$

That is, the mixing circuit 10 is designed so as to make the amplitude ratio of currents flowing through the antenna elements 1, 2 and 3 become 1:2:1, and the lengths $l_1$, $l_2$ and $l_3$ of the respective feeders 7, 8 and 9 are arranged so as to make current phase difference between the antenna elements 1 and 2 and between 2 and 3 become $k_od \pm \pi$, as follows:

$$k(l_1-l_2)=k(l_2-l_3)=k_od\pm\pi \quad (7)$$

where $k$ is a propagation constant in the feeder. When the ratio of propagation constant in the free space to that in the feeder is $\alpha$, $k$ is shown as $k=k_o/\alpha$. Therefore, the equation (7) is expressed as follows:

$$l_1-l_2=l_2-l_3=\alpha d\pm(\pi\alpha/k_o) \quad (8)$$

In the equation (8), $\alpha$ is a constant decided by the kind of feeder used and independent from the frequency. However, the equation (8) contains the propagation constant $k_o$ which changes according to the frequency. That is, the antenna of FIG. 1 has a frequency-dependent characteristic. A desirable high directivity is provided only around the pre-designed frequency, and so the antenna is used only for a very narrow band. Therefore, such antenna cannot be used as an antenna for television receiving for which a wide band characteristic is required.

Figure 2:
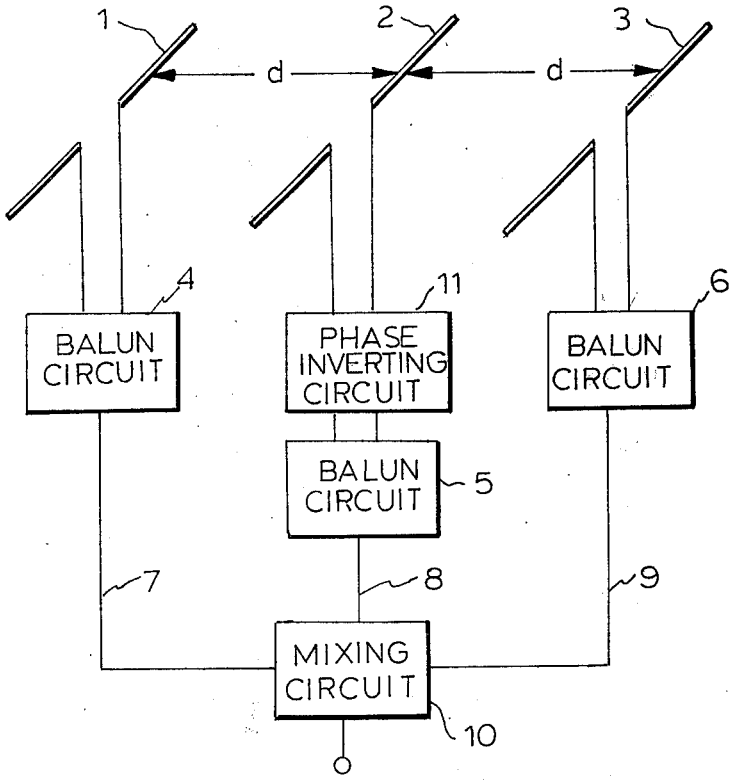
FIGS. 2 to 6 are schematic diagrams of various embodiments of endfire-type phased array antenna according to the invention.

Now, FIG. 2 shows an embodiment of an antenna according to the present invention, wherein the same parts as those shown in FIG. 1 are designated by the same reference numerals. That is, the antenna having three antenna elements comprises first, second and third antenna elements 1, 2 and 3, balun circuits 4, 5 and 6, co-axial type feeders 7, 8 and 9 having predetermined length $l_1'$, $l_2'$ and $l_2'$, respectively, a circuit 10 for mixing currents from the feeders 7, 8 and 9 or for distributing currents to these feeders, and a phase inverting circuit 11. The antenna according to the invention can be used as both the transmitting and receiving antennas. In the transmitting case, the above described circuit 10 acts as a distributing circuit for distributing current to the feeders in the amplitude ratio defined by the equation (5), and in the receiving case the circuit 10 acts as a mixing circuit for mixing current from the feeders also in the same amplitude ratio. As the phase inverting circuit 11 is connected only to the second antenna element 2, the lengths $l_1'$, $l_2'$ and $l_3'$ are defined as follows:

$$l_1'=l_1$$

$$l_2'=l_2\pm(\pi/k)$$

$$l_3'=l_3$$

Then, the above equation (7) becomes as follows:

$$k(l_1'-l_2')\pm\pi=k(l_2'-l_3')\pm\pi=k_od\pm\pi \quad (9)$$

From the equation $k=k_o/\alpha$ and a fact of $2\pi=0$, the equation (9) is expressed as follows:

$$l_1'-l_2'=l_2'-l_3'=\alpha d \quad (10)$$

As the equation (10) does not contain the propagation constant $k_o$, it becomes independent of the frequency. Accordingly, the antenna shown in FIG. 2 has a desirable high directivity in front of a wide frequency range.

Figure 3:
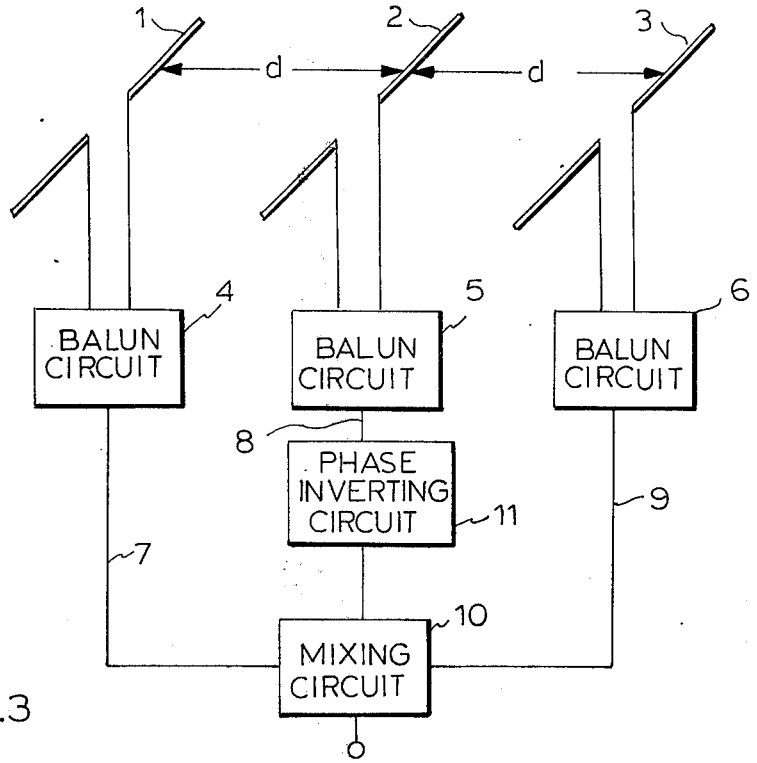

FIG. 3 shows another embodiment of the invention, in which the phase inverting circuit 11 is located on the feeder 8. The operation of this antenna is the same as that of the antenna of FIG. 2 and the desired high directivity is provided in front in a wide frequency range.

Figure 4:
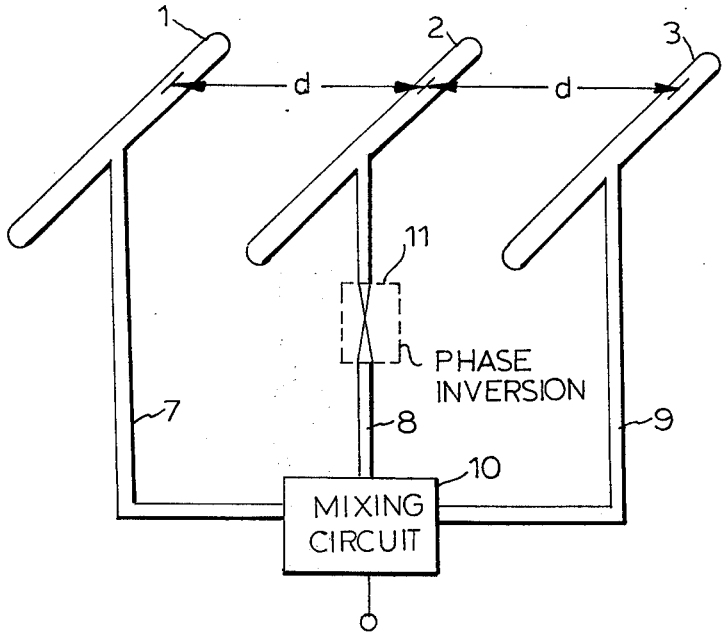

FIG. 4 shows further another embodiment of the invention, in which folded dipole is used as the antenna elements 1, 2 and 3, and twin lead balance type feeder is used for the feeders 7, 8 and 9. This twin lead balanced type feeder could be the same type as the 300Ωtwin lead feeder ordinarily used to feed half wavelength folded dipole antenna elements because its impedance matches the impedance of the antenna elements. In FIG. 4, the phase inverting circuit 11 is formed merely by crossing the feeders as described hereinafter. Also in this case, by suitably designing a mixing or distributing circuit and adjusting the length of the feeders 7, 8 and 9, there is provided the same operation as that of the antenna of FIG. 2 and a high directivity in front in a wide frequency range.

Figure 5:
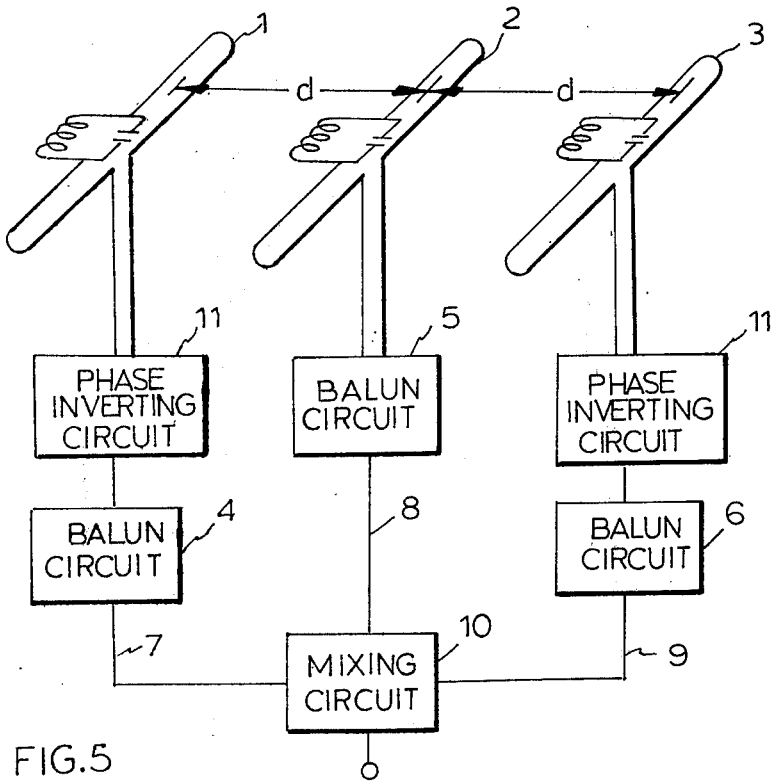

FIG. 5 shows further another embodiment of the invention, in which folded dipole designed to act in two frequency bands is used as the antenna elements 1, 2 and 3, and the phase inserting circuits 11 are connected between the first antenna element 1 and the balun circuit 4 and between the third antenna element 3 and the balun circuit 6. Also in this configuration, there is provided the same operation as that of the antenna of FIG. 2.

In the above embodiments shown in FIGS. 2 to 5, the condition of currents flowing through the antenna elements 1, 2 and 3 is set by the equations (5) and (6). Further, from consideration of antenna pattern synthesis, it is understood that the following condition of equations (11) and (12) also provides a directional antenna having a high directivity in front and not radiating in back:

$$\left.\begin{array}{l} I_1 = 1 \\ I_2 = 2\cos\dfrac{k_od}{2} \\ I_3 = 1 \end{array}\right\} \quad (11)$$

$$\left.\begin{array}{l} \phi_1 = O \\ \phi_2 = \dfrac{k_od}{2} \pm \pi \\ \phi_3 = k_od \pm 2\pi \end{array}\right\} \quad (12)$$

Therefore, the circuit 10 is designed so as to provide a ratio of $1:2\cos(k_o d/2):1$ of current amplitudes flowing through the antenna elements 1, 2 and 3, and the lengths $l_1''$, $l_2''$ and $l_3''$ of the feeders 7, 8 and 9 are adjusted so as to provide a current phase difference of $k_o d/2 \pm \pi$ between the antenna elements 1 and 2 and between 2 and 3, that is, as the following equation:

$$l_1'' - l_2'' = l_2'' - l_3'' = (\alpha d/2) \tag{13}$$

When the interval $d$ between the adjacent antenna elements is much smaller than a wavelength, $2\cos(k_o d/2)$ becomes nearly 2 ($2\cos(k_o d/2) \approx 2$). Accordingly, the current amplitude ratio and current phase difference become 1:2:1 and $k_o d/2 \pm \pi$, respectively independently of the frequency, and so there is provided a desired high directivity in a wide frequency range.

Although it is described, in the above embodiments, for the equations (5) and (6) or (11) and (12) as the conditions for the currents flowing through the antenna elements 1, 2 and 3, the other conditions in addition are also considered in antenna pattern synthesis for getting a high directivity in front and no radiation in back. Also in these cases, corresponding to the conditions, the mixing or distributing circuit is designed so as to provide a required current amplitude ratio and the length of the feeders is arranged so as to provide a required current phase difference. Further, the phase inverting circuit is connected between the second (or the first and third) antenna element and the balun circuit or the balance type feeder. Then, the resultant antenna has a desired high directivity in a wide frequency range.

While the embodiments described hereinbfore are the endfire-type phased array antenna comprising three antenna elements, the invention can be applied to an antenna comprising $n$ pieces of antenna elements. For example, in FIG. 6, odd antenna elements 1, 3, 5, . . . are connected directly to the respective balun circuit, and even antenna elements 2, 4, 6, . . . are connected to the respective balun circuit through the phase inverting circuit. Each of the feeders is arranged in a required length and connected to a mixing or distributing circuit. When the values of current flowing through these antenna elements are $I_1\epsilon^{j\phi_1}$, $I_2\epsilon^{j\phi_2}$, $I_3\epsilon^{j\phi_3}$ . . . , $I_i\epsilon^{j\phi_i}$ . . . $I_n\epsilon^{j\phi_n}$ the conditions for getting a high directivity in front and no radiation in back are provided as follows from consideration of antenna pattern synthesis theory:

$$\left.\begin{aligned} I_1 &= 1 \\ I_2 &= n-1 \\ I_3 &= \frac{(n-1)(n-2)}{2!} \\ &\vdots \\ I_i &= \frac{(n-1)!}{(i-1)!\,(n-i)!} \\ &\vdots \\ I_n &= 1 \end{aligned}\right\} \tag{14}$$

$$\left.\begin{aligned} \phi_1 &= 0 \\ \phi_2 &= k_o d \pm \pi \\ \phi_3 &= 2(k_o d \pm \pi) \\ &\vdots \\ \phi_i &= (i-1)(k_o d \pm \pi) \\ &\vdots \\ \phi_n &= (n-1)(k_o d \pm \pi) \end{aligned}\right\} \tag{15}$$

Considering relations of $\pm 2\pi = \pm 4\pi = \ldots = 0$ and $\pm\pi = \pm 3\pi = \pm 5\pi = \ldots = \pi$, the odd antenna elements are connected directly to the respective balun circuit and the even antenna elements are connected to the respective balun circuit through the phase inverting circuit. Further, the mixing or distributing circuit is designed so as to make the amplitude ratio of currents flowing through each antenna element coincident with the equation (14), and the length of the feeder is adjusted so as to make the current phase difference among the antenna elements be $k_o d \pm \pi$. Then, a high directivity independent of the frequency is provided, and the antenna becomes a wide band directional antenna.

Figure 6:
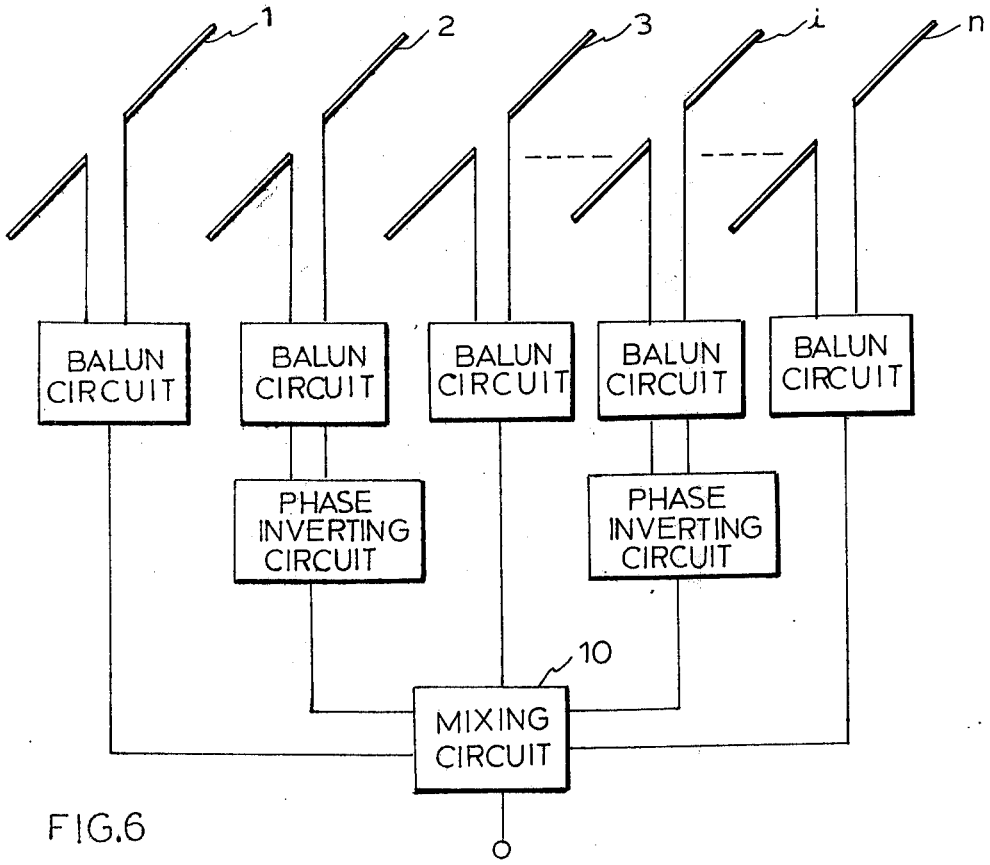
Figure 7A:
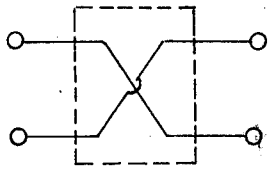
Figure 7B:
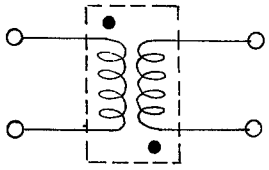
Figure 7C:
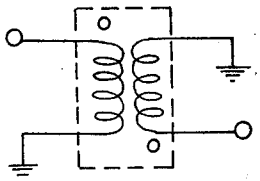
Figure 7D:
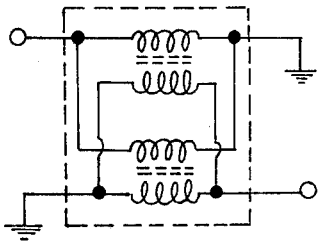

For the antenna shown in FIG. 6, the odd antenna elements are directly connected to the respective balun circuit and the phase inverting circuits are connected to the even antenna elements. The same effect can be also provided by connecting the phase inverting circuit to the odd antenna elements and by connecting the even antenna elements directly to the balun circuits. The antenna element used for the antenna of the invention includes any antenna such as dipole or folded dipole, but it is desirable that at least all of $n$ antenna elements have the same impedance characteristic.

FIGS. 7*a* to *d* show examples of the phase inverting circuit, in which *a* and *b* show examples of balance type phase inverting circuits and *c* and *d* show examples of unbalance type phase inverting circuits. For the phase inverting circuit, a circuit of low loss for inverting only the phase while keeping the same amplitude is desirable.

Figure 8A:
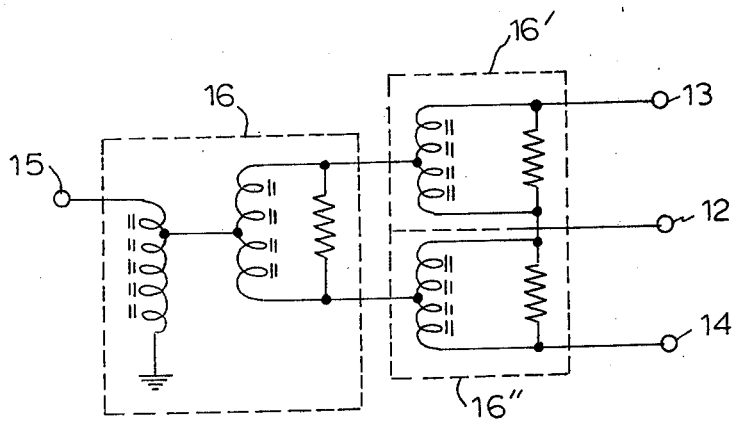
Figure 8B:
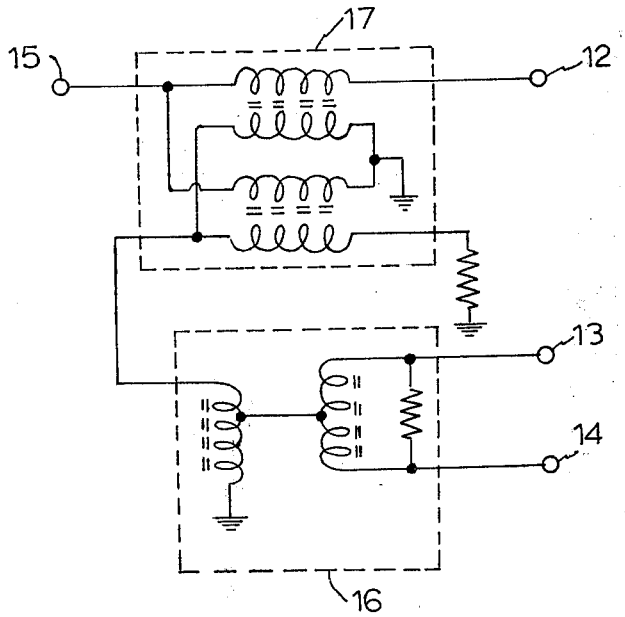
Figure 8C:
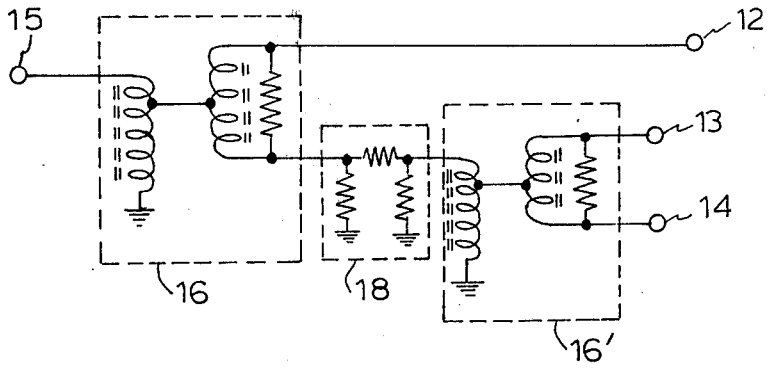

For the mixing or distributing circuit, it is suitable to use a hybrid two-distributor, a directional coupler or a combination thereof, and coupling between distributing terminals should be as small as possible in order to reduce mutual influence among the antenna elements. FIGS. 8*a* to *c* show examples of the mixing or distributing circuit 10 for the three-elements antenna shown in FIG. 2. FIG. 8*a* shows a combination of hybrid two-distributors 16, 16' and 16'', and terminals 12, 13 and 14 are connected to the feeders 8, 7 and 9 in FIG. 2, respectively. Terminal 15 is a feeding terminal of the antenna of FIG. 2. FIG. 8*b* shows a combination of a directional coupler 17 and a hybrid two-distributor 16. The amplitude ratio of current flowing to the terminals 12, 13 and 14 can be adjusted to a desired value by suitably selecting a winding ratio of the transformers of the hybrid two-distributor and the directional coupler in FIGS. 8*a* and *b*. In case of FIG. 8*c* showing a combination of hybrid two-distributors 16 and 16' and fixed or variable attenuator 18, the amplitude ratio of current flowing to the terminals 12, 13 and 14 can be adjusted to a desired value by suitably selecting the amount of attenuation of the attenuator 18.

FIG. 9 shows an embodiment wherein the phase inverting circuit is contained in the mixing or distributing circuit. When the directional coupler 17 in FIG. 8*b* showing the mixing or distributing circuit composed of a combination of the directional coupler 17 and the hybrid two-distributor 16 is connected as 17' in FIG. 9, a phase relation between the terminals 12 and 13 or 14 becomes different just by 180° from FIG. 8*b*. Therefore, by using the mixing or distributing circuit of FIG. 9, the phase inverting circuit shown in FIG. 7 becomes unnecessary.

Further, while one mixing or distributing circuit is used in the antenna shown in FIGS. 2 to 6, it is also possible to use a plurality of mixing or distributing circuits which are connected to each other through a feeder having suitable length. FIG. 10 shows such an embodiment, in which the antenna comprises first, second and third antenna elements 1, 2 and 3, balun circuits 4, 5 and 6, feeders 7, 8, 9 and 19 having predetermined lengths, respectively, phase inverting circuit 11, hybrid two-distributors 16 and 16', fixed or variable attenuator 18, and feeding terminal 15. By suitably selecting the attenuation amount of the attenuator 18 and the lengths of the feeders 7, 8, 9 and 19, desired current amplitude ratio and current phase are provided to each antenna element, and so an antenna having a desired directivity can be provided.

What is claimed is:

1. An endfire-type phased array antenna comprising $n$ dipole antenna elements wherein $n$ is an integer greater than 2 arranged in parallel to each other on the same plane each of said $n$ antenna elements having a feeding means connected thereto said feeding means having a pre-determined length, respectively, a mixing and distributing circuit connected to each of said feeding means for mixing the currents flowing through said feeding means with a pre-determined current amplitude ratio into said mixing circuit in the case when said antenna is used as a receiving antenna, said circuit being one for distributing the currents into said feeding means with said predetermined current amplitude ratio in the case when said antenna is used as a transmitting antenna for causing the direction of maximum response of said antenna to lie along the plane of the array, said antenna containing also phase inverting circuits, wherein alternating antenna elements from among said $n$ antenna elements are connected directly to each of said $n$ feeding means and the remaining alternating elements are coupled to the said mixing circuit through said phase inverting circuits.

2. An endfire-type phased array antenna according to claim 1, wherein each of said phase inverting circuits present is combined in said mixing or distributing circuit.

3. An endfire-type phased array antenna according to claim 1, wherein said $n$ is 3, said antenna elements are disposed linearly having a distance $d$ between adjacent antenna elements and said mixing and distributing circuit comprises means for causing the currents $I_1$, $I_2$ and $I_3$ flowing through the 3 respective dipole antenna elements to satisfy a current amplitude ratio of $I_1:I_2:I_3=1:2:1$, and said pre-determined lengths of said feeding means are chosen for causing the phases $\phi_1$, $\phi_2$ and $\phi_3$, respectively, to satisfy the relations $\phi_2 = k_o d \pm \pi$ and $\phi_3 = 2(k_o d \pm \pi)$ on the basis of $\phi_1(\phi_1=0)$, where $k_o=2\pi/\lambda$, $d$ is the distance between the dipole antenna elements, and $\lambda$ is the wavelength.

4. An endfire-type phased array antenna according to claim 1, wherein said $n$ is 3, said antenna elements are disposed linearly having a distance $d$ between adjacent antenna elements and said mixing and distributing circuit comprises means for causing the currents $I_1$, $I_2$ and $I_3$ flowing through the 3 respective dipole antenna elements to satisfy current amplitude ratio of $I_1:I_2:I_3=1:2\cos(k_o d/2):1$, and said predetermined lengths of said feeing means are chosen for causing the phases $\phi_1$, $\phi_2$ and $\phi_3$, respectively, to satisfy the relations $\phi_2=(k_o d/2)\pm\pi$ and $\phi_3=k_o d\pm 2\pi$ on the basis of $\phi_1(\phi_1=0)$, where $k_o=2\pi/\lambda$, $d$ is the distance between the dipole antenna elements, and $\lambda$ is the wavelength.

5. An endfire-type phased array antenna according to claim 1, wherein said antenna elements are disposed linearly having a distance $d$ between adjacent antenna elements and said mixing and distributing circuit comprises means for causing the current amplitude of the $i$th antenna element $I_i$ to satisfy the relation:

$$I_i = \frac{(n-1)!}{(i-1)!\,(n-i)!} I_1$$

wherein $I_1$ is the current amplitude of the first antenna element and $n$ is the number of antenna elements and said predetermined lengths of said feeding means are chosen for causing the phase of the current of the $i$th antenna element $\phi_1$ to satisfy the relation:

$$\phi_i = (i-1)(k_o d \pm \pi) + \phi_1$$

wherein $\phi_1$ is the phase of the current of the first antenna element, $k_o=2\pi/\lambda$ where $\lambda$ is the wavelength and $d$ is the distance between adjacent antenna elements.

6. An endfire-type phased array antenna according to claim 1, wherein said feeding means are twin lead balance type feeders.

7. An endfire-type phased array antenna according to claim 6, wherein said phase inverting circuits are formed by crossing said twin lead balance type feeder.

8. An endfire-type phased array antenna according to claim 1, wherein said feeding means comprise a balun circuit connected to each of said antenna elements and a co-axial type feeder connected to each of said balun circuits.

9. An endfire-type phased array antenna according to claim 8, wherein each of said phase inverting circuits present is connected between the antenna element and the balun circuit.

* * * * *